United States Patent [19]

Guennou

[11] Patent Number: 4,755,807

[45] Date of Patent: Jul. 5, 1988

[54] COLORED DEVICE FOR DATA DISPLAY

[75] Inventor: Serge Guennou, Croissy Sur Seine, France

[73] Assignee: U.S. Philips Corp., New York, N.Y.

[21] Appl. No.: 841,130

[22] Filed: Mar. 18, 1986

[30] Foreign Application Priority Data

Mar. 26, 1985 [FR] France ..... 85 04473

[51] Int. Cl.[4] ..... G08B 5/36

[52] U.S. Cl. ..... 340/702; 340/782; 340/762

[58] Field of Search ..... 340/762, 702, 703, 704, 340/701, 800, 782, 752; 313/510, 500, 513, 514, 515, 516, 517, 518, 519, 520, 521, 522; 40/450, 451, 452, 550, 551, 552

[56] References Cited

U.S. PATENT DOCUMENTS

| | | | |
|---|---|---|---|
| 4,271,408 | 6/1981 | Teshima et al. | 340/782 |
| 4,321,598 | 3/1982 | Warner | 340/782 |
| 4,488,149 | 12/1984 | Given | 340/762 |
| 4,560,901 | 12/1985 | Thillays | 313/499 |

FOREIGN PATENT DOCUMENTS 2569894 3/1986 France .

*Primary Examiner*—John W. Caldwell, Sr.
*Assistant Examiner*—Alvin Oberley
*Attorney, Agent, or Firm*—Paul R. Miller

[57] ABSTRACT

A device for the display of data, comprising on the one hand a matrix of luminous dots (11*a*, 11*b*, . . . 11*n*) each of which is constituted by at least one pair of light-emitting diodes arranged in anti-parallel with the color of the light emitted by one diode of the pair being different from that of the other diode, and comprising on the other hand, an electric a.c. voltage supply source (16) whose output terminals (17 and 18) can be coupled to the supply terminals of the luminous dots by electronic switches (25*a*, 25*b* . . . 25*m*) controlled by a control signal generator (30). A color variation requirement, referred to as "background" of the sign, is obtained by rendering the electronic switches (25*a*, 25*b*, . . 25*m*) conducting during one and/or the other cycles of the supply voltage, while the data to be displayed are formed by the assembly of luminous dots (11*i*, 11*j*) whose connections are connected to the supply source (16) in accordance with a polarity which is inverse to that of other luminous dots which constitute the complementary "background" hue.

7 Claims, 4 Drawing Sheets

COLORED DEVICE FOR DATA DISPLAY

The invention relates to a device for data display, comprising a matrix of luminous dots disposed in rows and columns on a support, each luminous dot having a first and a second connection terminal and comprising at least one pair of light-emitting diodes, the first diode of the pair emitting light in a first colour and being connected in accordance with a given polarity to said first and second connection terminals, the second diode of the pair emitting light in a second colour different from the first colour and being connected to the connection terminals in inverse polarity with the first diode, the device furthermore comprising an a.c. voltage supply source whose output terminals are coupled to the connection terminals of the luminous dots by means of electronic switches controlled by a control signal generator, which signals are chosen to be time-variable to render the switches conducting during one and/or the other alternation of the supply voltage in accordance with a colour variation requirement desired for the light emission of the matrix dots.

A device of the type described for visualising luminous information is described in French Patent Application No. 84 13 605 filed on Sept. 4, 1984 in the name of the Applicant corresponding to published application U.S. Pat. No. 2,569,894, published on Mar. 7, 1986; This Application describes how the movement of characters referred to as an electric newspaper providing a display in at least three colours can be realised by controlling the closure of series/arranged electronic switches in the supply of the luminous dots emitting, for example, a green light during positive cycles of the supply voltage, a red light during negative cycles while a yellow-/orange light is seen during two successive cycles as the sum of the basic light impressions when the frequency of the supply voltage is sufficiently high and when the diodes of the two colours constituting a luminous dot are so closely positioned near each other that the eye cannot separately distinguish them.

It is possible to use polarity/reversible devices as electronic switches such as triacs or unidirectional devices such as transistors or thyristors provided that the latter are diagonally arranged in a bridge with four rectifier diodes.

The particular importance of using photocontrollable electronic switches such as photo-triacs or photo-transistors is likewise emphasized by the fact that they provide an isolation and a complete independence between the a.c. supply circuit for the luminous dots and the control circuits for the switches, which may be in the form of d.c. voltage-supplied logic current elements.

Finally the above-mentioned Application describes how an electric newspaper with running characters emitting light in various colours can be conceived in accordance with a structure similar to that of a monochrome newspaper, however, on the condition that the part of the data control circuits and the control circuits for the switches which is specific of a given colour is repeated as many times as there are basic colours and-/or luminous levels chosen for each basic colour. For programming the visualization of data in the prior art device it is necessary to store successively and separately the elements of these data relating to each basic colour (and/or to the luminous level) and subsequently to exploit them all together in accordance with the planned sequence of visualisation by applying the control signals to the switches for each luminous dot along separate paths associated with each colour or luminous intensity in the same colour.

Thus it is clear that the prior art device uses means for storage, means for data control and for the control of the switches, which are of a relatively considerable number and complex by and thus costly in so far as the number of luminous dots to be controlled is also of a quite considerable number.

It is therefore an object of the invention to provide a novel device which uses simplified means and which meets specific applications corresponding to one sign, that is to say, the quantity of data to be displayed is sufficiently reduced to be contained in one time in the dot matrix.

According to the invention a device of the type described in the opening paragraph is characterized in that the colour variation requirement determined by the control signals is independent of the data to be displayed and provides a colour variation referred to as "background" for the assembly of dots for which the first and second connection terminals are coupled to the respective output terminals of the supply source in accordance with a given polarity referred to as "background polarity", whereas other matrix dots selected for representing the data to be displayed have their first and second connection terminals coupled to the respective output terminals of the supply source in accordance with a polarity which is inverse to the background polarity.

To explain the invention in very simple terms, one could say that the matrix dots are applied on the support in a removable manner, while all the dots constituting the "background" are connected in accordance with a uniform polarity and the dots constituting the displayed message are disconnected and returned to their support so that the light emitted by these dots has a colour which is different from that of the light emitted by the "background" dots. In an advantageous embodiment of the invention the first and second output connections of the luminous dots are mounted in the device in a removable way by means of a pin-pluggable connection with the support.

According to this embodiment, any modification of the message can be very simply obtained in removing luminous dots which are concerned by the modification and in plugging them again on their sockets with the suitable polarity. Advantageous use can be made of a component as a luminous dot with two connection terminals integrating within the same cabinet two semiconductor crystals of a different nature and having a pn junction and an np junction, respectively, which are connected in parallel with the the terminals with the crystals in the component being fixed side by side in a reflecting cavity so that their light emerges from the cabinet substantially under the same angle. Such components have been described in French Patent Application No. 2.520.934.

To form a luminous dot in devices of large dimensions, a plurality of components of the same type may be grouped together and may be electrically interconnected either in parallel or in series, or in a series-parallel combination. It is alternatively possible to use single crystal light-emitting diodes connected in antiparallel pairs formed by diodes for different colours and arranged in each other's proximity.

In all cases the diodes for one colour are connected to the connection terminals of the luminous dot in accordance with a uniform polarity.

The data to be displayed are manually composed dot by dot, and may present a text of arbitrary characters, but also symbols or any other image. The data presented are fixed, but may be recomposed arbitrarily and unrestrictively.

The device according to the invention does not require the use of any keyboard, any character or symbol store or any microprocessor. Yet it has a particularly economic construction. The liveliness of the background colour produces an agreeable effect and attracts the attention of persons to whom the data are addressed. The data appear in the complementary hue of the background colour, for example: green on a red background or red on a green background. In contrast, the data fade away on a yellow-orange background.

In accordance with an advantageous method of realising the invention, the device is characterized in that a plurality of luminous dots is coupled to the output terminals of the supply source by means of an electronic switch with the plurality of dots forming a figure on the matrix referred to as "elementary background figure" which is independent of the data to be displayed.

The elementary background figure may be an array on the dot matrix, that is to say, either a row or a column.

The coupling of the luminous dots of the elementary figure to the supply source may be constituted by connecting these dots in series, in parallel or in series-parallel. With respect to a device using an electronic switch for the control of each luminous dot, the device according to the embodiment of the invention is very economic in that the number of switches required is divided by the number of dots contained in the elementary figure, for example, the number of dots per row or per column.

The animation of colours in the device according to the invention may be very varied; some are very advantageous due to the simplicity of the means which they require with respect to the visual effect presented.

The invention will now be described in greater detail with reference to the accompanying drawings in which FIG. 1 is a schematic representation of the device according to the invention, FIG. 2 shows an example of a luminous dot with its two polarity connections, FIG. 3 schematically shows another luminous dot formed from various diode pairs, FIG. 4 shows in a partial schematic diagram another form of a device according to the invention, FIG. 5A to 5F show examples of electronic switches which may be used to realise the invention, FIG. 6 is an electrical circuit diagram of a control signal generator for the electronic switches, FIG. 7 shows the electrical circuit diagram of another example of a control signal generator for the electronic switches.

The device shown schematically in FIG. 1 consists on the one hand of a support on which luminous dots 11*a*, 11*b*, 11*c*, . . . 11*n* are arranged in a matrix, and on the other hand an electric a.c. supply source 16 whose output terminals 17 and 18 are coupled to the connection terminals of the luminous dots 11*a* . . . 11*n* by means of electronic switches 25*a*, 25*b* . . . 25*m*.

In the embodiment of FIG. 1 the luminous dots of a column are interconnected in series and the assembly of columns is fed by an electronic switch and a current-limiting impedance such as a resistor R1.

The electronic switches 25*a* . . . 25*m* are controlled by a control signal generator 30 which produces at its output terminals 301, 302, 303 . . . 311, 312, 313 . . . signals rendering the electronic switches conducting during one and/or the other cycle of the voltage of the electronic supply source 16. In the embodiment illustrated the group of outputs 301, 302, 303 . . . 30*m* supplies signals render the electronic switches conducting during the cycles of a first polarity and the group of outputs 311, 312, 313 . . . 31*m* activate the same electronic switches during the cycles of the second polarity.

The details for the formation of a luminous dot are shown in FIG. 2. The dot 11*a* comprises a first connection terminal 12, a second connection terminal 14 and a pair of light-emitting diodes 20, 21 connected antiparallel to the terminals 12 and 14. By way of example, the diode 20 emits a green light and has its anode connected to the connection terminal 12 and its cathode connected to the connection terminal 14, while the diode 21 emits a red light and is connected to the connection terminals 12 and 14 in a manner inverse to the diode 20. The other luminous dots of the matrix are constituted by identical elements connected in a similar manner.

The luminous dots are provided on the support in a removable manner, for example, by means of plug-ins. The terminals 13 and 15 of FIG. 2 show the fixed connection elements forming part of the support and to which the luminous dots are connected.

To prepare the visualisation of a given information, the luminous dots which are situated outside the information and thus constitute the background colour of the luminous sign are connected in accordance with a first uniform polarity with respect to the terminals 17 and 18 of the electric supply source 16. On the other hand the luminous dots representing the information to be displayed are connected in accordance with a second polarity inverse to the first.

If in the embodiment the luminous dots of a row emit a green light at a given instant when they are connected in accordance with the polarity corresponding to that of dot 11*a* of FIG. 2, the luminous dots which are connected in accordance with an inverse polarity will emit a red light at the same instant. The luminous dot 11*i* of FIG. 2 shows the same arrangement as dot 11*a* but is turned 180° so that when dot 11*i* is inserted in the position of dot 11*a* the first connection terminal 12 of the dot will be connected to the fixed terminal 15 forming part of the support while the second connection terminal 14 will be connected to the fixed terminal 13 of the support. Thus in FIG. 1 the dots 11*i*, 11*j* . . . connected with an inverse polarity will display information having a red colour on a green background constituted by the other dots 11*a*, 11*b*, 11*c* . . . , while at another instant the same information may appear in green characters on a red background. The colour variation required as a function of time is determined by the control signal generator 30 which comprises the terminals 37 and 38 connected to the output terminals 17 and 18, respectively, of the electric supply source 16 such that the control signals are synchronised at half cycles of the alternating supply voltage, for example, at 50 Hz.

FIG. 3 shows the diagram of a luminous dot for signs of large dimensions constituted by six pairs of light-emitting diodes in a series-parallel arrangement, each pair comprising two diodes of a different colour and connected in an anti-parallel arrangement with respect to each other. The reference numerals identical to those in FIG. 2 as well as the graphic arrangements clearly show how the diodes of the same colour are connected to the first and second connection terminals 12 and 14 of the luminous dot at a given polarity.

FIG. 4 shows the connection diagram of the luminous dots of a variant of the sign shown in FIG. 1. According to FIG. 4 the luminous dots 11 of the dot matrix are interconnected in series along each row whose extremities are fed by the electric supply source 16. Each row A, B, C . . . of dots comprises an electronic switch 25 in series as well as a current limiting impedance R. According to the variant of FIG. 4, in which the control of the switches 25 is not shown, the colours appear successively in a vertical sense while the background colour of all the dots of one row are identical at a given instant to the difference of the dot matrix of FIG. 1 in which all the dots of one column have the same background colour at a given instant and in which the colours appear successively lateral sense from right to left or from left to right.

In these two embodiments the assembly of series-connected dots (a row in FIG. 4 and a column in FIG. 1) is referred to as the "elementary background figure" which groups a plurality of luminous dots in accordance with a configuration which is independent of the data to be displayed and whose supply is controlled by a single electronic switch. It is obvious that elementary background figures other than those shown in the embodiment may also be used, that is to say, any regular group of consecutive dots on the matrix. Likewise as the interconnection in series of all the dots of an elementary background figure is advantageous because it allows of a weak current and a relatively high voltage supply, any other parallel or series-parallel connection is also possible.

The fact that a plurality of luminous dots is coupled to the output terminals of the supply source by means of one and the same electronic switch provides the advantage of a substantial economy in components to be used for realising the sign according to the invention, allows for simpler wiring of the dot matrix and reduces the complexity of the control signal generator whose number of outputs is considerably reduced.

From this point of view the arrangement of FIG. 4 is more economical than that of FIG. 1 for a rectangular device with dots whose number of rows is higher than the number of columns because it permits of a considerable reduction in the number of electronic switches and corresponding control means.

FIGS. 5A to 5F show various assemblies that can be used as controllable bidirectional electronic switches as are denoted by the reference numerals 25*a*, 25*b* . . . 25*m* in the diagram of FIG. 1.

More particularly FIG. 5A shows a triac whose control electrode C1 is the gate electrode, FIG. 5B shows the assembly diagram of a bipolar transistor whose emitter-collector path is connected diagonally to a rectifier bridge with four diodes, with the control electrode C1 being the base of the transistor. FIG. 5C shows that a thyristor may likewise be used if its principal current path is connected diagonally to a point with four diodes, the control electrode C1 then being the gate of the thyristor.

Figure 6:
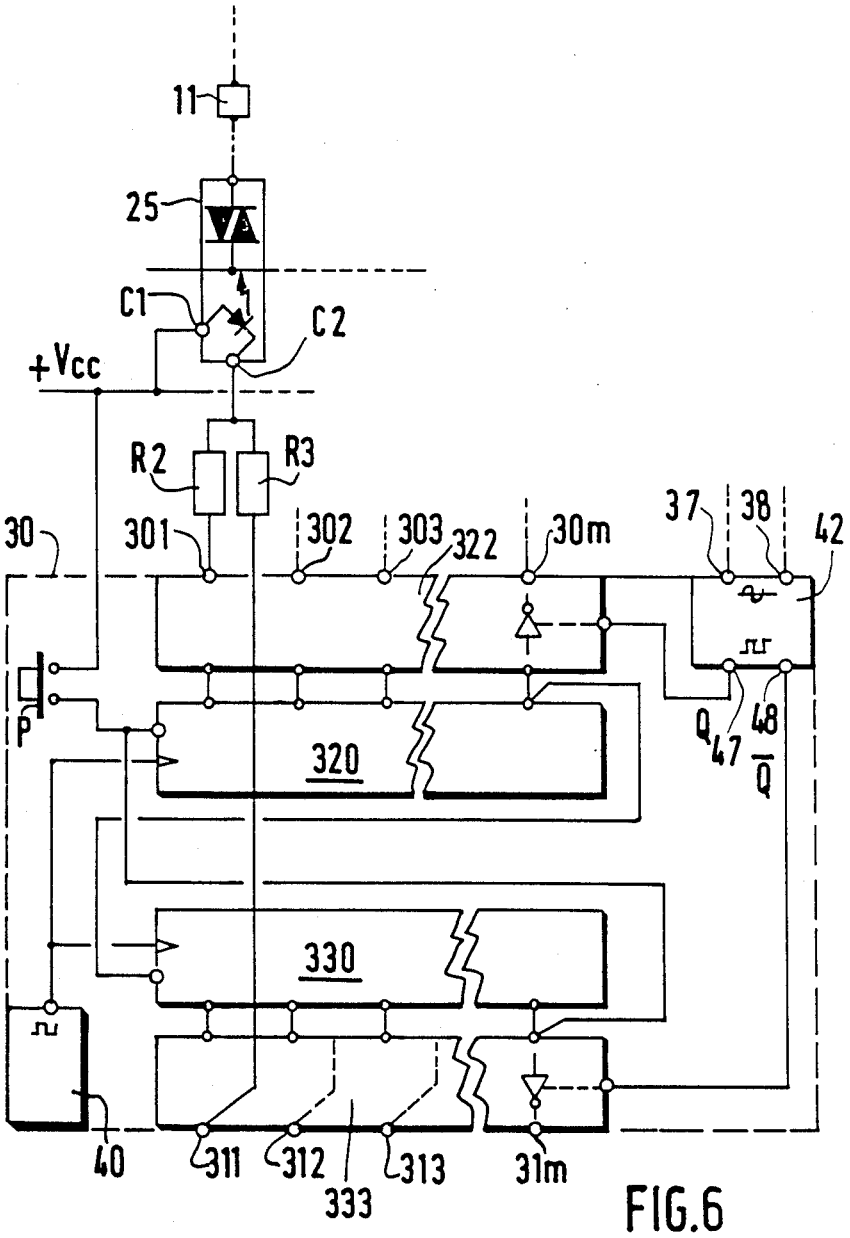
FIG. 6 shows an embodiment of a diagram of the control signal generator 30 for the control of the switches of a device in accordance with FIG. 1.

This FIG. 6 shows a single electronic switch 25 and a single luminous dot 11. The electronic switch 25, which is a photo triac, is controlled at its terminal $C_1$ and $C_2$. The terminal $C_1$ corresponding to the anode of the control diode is connected to a continuous voltage source $+V_{cc}$ and the terminal $C_2$ corresponding to the cathode of the control diode receives the control signals from the generator 30, from both an output terminal 301 via the resistor R2 and from an output terminal 311 via the resistor R3.

As will be hereinafter described in greater detail, the signals which are active in the low state, are only present at the terminal 301 during the cycles of a first polarity which is, for example, positive of the a.c. supply voltage, whereas the signals of the terminal 311, which are likewise active in the low state, can only be present during the cycles of the second polarity, that is to say, the negative alternations.

The essential function of the resistors R2 and R3 is to ensure a protection against possible current peaks during the transient time of the signals.

Figure 1:
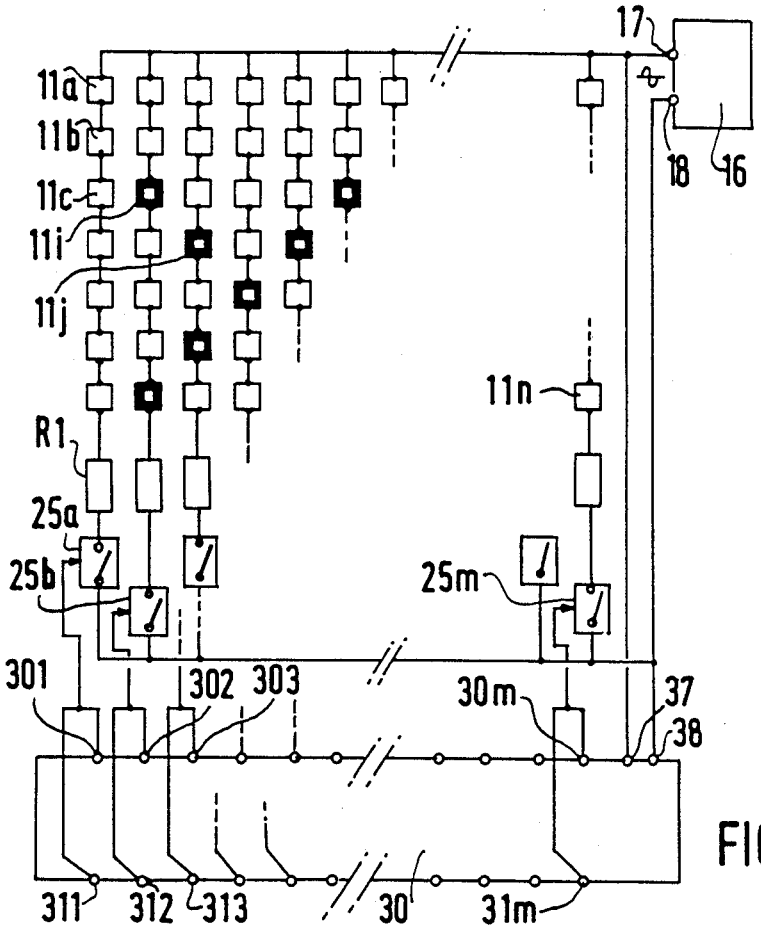
Figure 2:
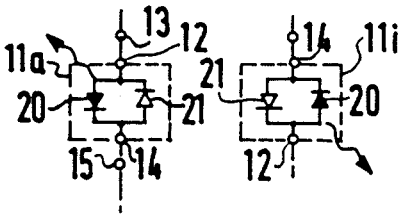
Figure 3:
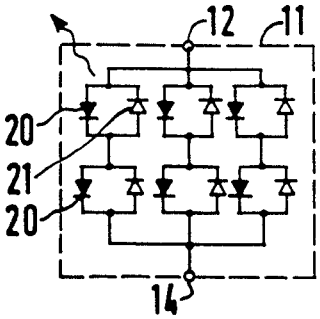
Figure 4:
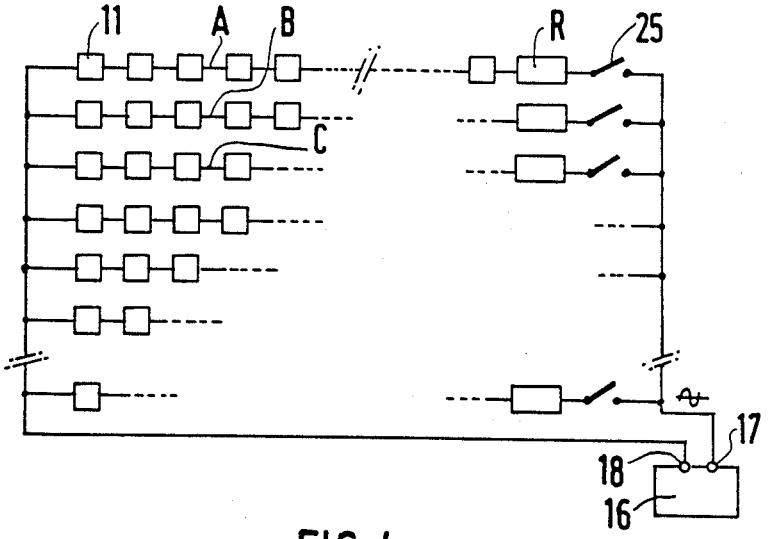

The control signal generator 30 comprises a first shift register 320 whose m outputs are connected to m inputs of a set of buffer amplifiers 322 comprising m output terminals 301, 302, 303 . . . for the control of each electronic switch 25. In conformity with FIG. 1 the number m of electronic switches corresponds to the number of columns of the dot matrix, for example, 72 columns.

The generator 30 also comprises a second shift register 330 which in a manner similar to that of the first register 320 is connected to a second set of buffer amplifiers 333 comprising m output terminals 311, 312, 313 . . . .

To obtain a shift register with 72 stages it is sufficient to series-arrange nine elementary registers having 8 stages each. The signal input terminal of the first shift register 320 may be instantaneously connected to $+V_{cc}$ by means of a push button P. The last output of this register, of the row m, is connected to the signal input of the second shift register 330 whereas the output of the row m of the latter shift register is connected to the signal input of the first register 320 with the two shift registers thus being connected in a ring as far as their inputs and outputs are concerned.

The clock input terminals of the registers 320 and 330 are both connected to the output of a multivibrator 40 determining the successive activation of the background colour of the luminous signs.

The control signal generator also comprises a squarewave signal generator 42 which receives at its terminals 37 and 38 the alternating voltage from the supply source which applies at one end, to a terminal 47, squarewave signals whose levels are compatible with the associated logic circuits and which are in phase with the alternating voltage and at the other end to a terminal 48, similar signals but in anti-phase with the former signals. These signals denoted by Q and $\overline{Q}$ at the connection connected to the terminals 47 and 48 are applied to enable terminals of buffer amplifiers 322 and 333, respectively. Since the buffer amplifiers used in the embodiment are of the inverse type, they produce signals at the output which signals are active in the low state, whereas they are in the high state at the input and the enable input is activated. In contrast, when the enable input is not activated, the outputs of the buffer amplifiers are blocked in a state of high impedance independent of the state of the signal at the input. It follows that the signals in the shift register 320 are transmitted to the outputs 301, 302, 303 . . . only during the positive cycles of the supply voltage under the control of signal Q, whereas the signals in the shift register 330 are only transmitted to the outputs 311, 312, 313 . . . during the negative cycles under the control of signal $\overline{Q}$. Thus the control signals supplied by the group of output terminals 301, 302, . . . 30*m* produce the illumination of the successive columns of luminous dots in, for example, a green background colour, whereas the signals supplied by the group of output terminals 311, 312, . . . 31*m* produce the illumination of the columns of luminous dots in a red background colour. If the electronic switches are activated during the two successive voltage alternations, the luminous dots appear in a yellow-orange colour.

When a voltage is applied to the circuit, the shift registers 320 and 330 are in their low state in all their stages and consequently all matrix dots are extinguished. When an instantaneous pressure is exerted on the switch P, a progressive series of columns of luminous dots is illuminated in a green background colour at the rate of movement fixed by the multivibrator 40. When the first active signal is transferred from the last stage of the shift register 320 to the first stage of the shift register 330, i.e. in the red background colour, the columns of luminous dots are progressively illuminated. If the switch P is released before the matrix dots are entirely illuminated in the green colour, the luminous dot-ensemble will show successive waves of movements in the green and red background colours, separated by non-luminous intervals. If on the other hand the switch P is released shortly after a first complete illumination in the green background colour, the luminous dot-ensemble will show successive waves of movements in the green background colour and then in red, separated by yellow-orange coloured intervals.

Since the shift registers 320 and 330 are arranged in a ring, the control of the switches proceeds indefinitely in accordance with the same cycle which is initiated by pressure on the switch P.

It can be readily understood that other moving coloured animations of the luminous dots can be obtained either by applying several short-lasting pressures on the switch P or by splitting up the shift registers into several modules and by connecting these modules together in a ring, but by successively alternating the control modules for the green colour and the control modules for the red colour in the ring.

Figure 7:
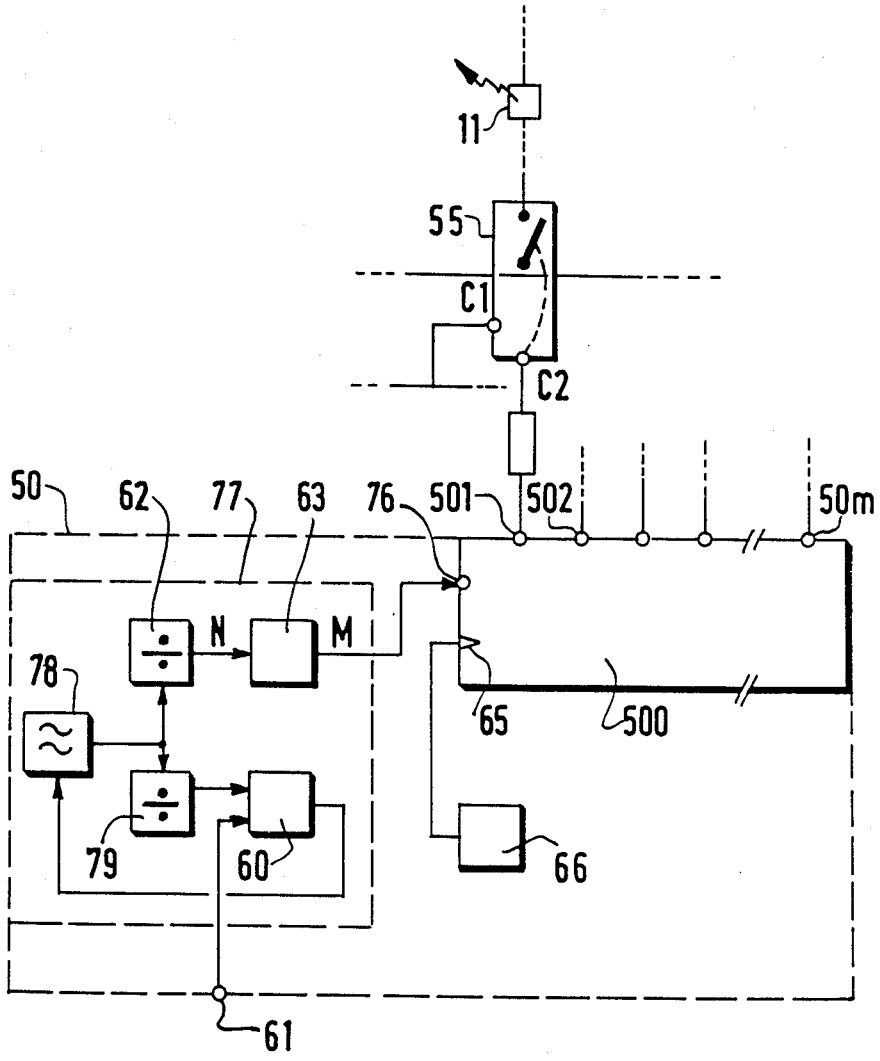

Finally FIG. 7 shows the principle circuit diagram of a control signal generator different from that shown in FIG. 6 for a coloured animation of the luminous dot-ensemble in accordance with successive and moving waves whose colour progressively passes from green to red and inversely.

Figure 5A:
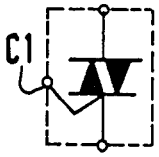
FIGS. 5D to 5F show the same assemblies as those shown in FIGS. 5A to 5C with the difference that the triac, the transistor or the thyristor are photocontrolled, for example, by means of a light-emitting control diode connected to the control terminals C1 and C2.
Figure 5B:
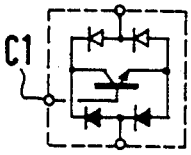
Figure 5C:
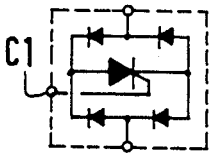
Figure 5D:
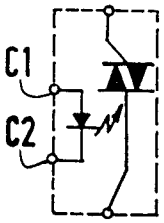
Figure 5E:
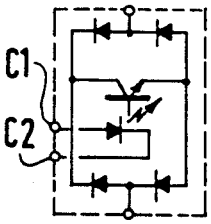
Figure 5F:
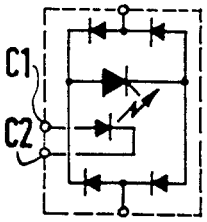

The control signal generator 50 comprises a single shift register 500 with m stages whose m outputs 501, 502 . . . 50*m* control the successive electronic switches 55 for m elementary background figures contained in the luminous dot matrix. The electronic switches 55 are of the transistor photocoupling type arranged in a diode bridge of the type shown in FIG. 5E.

The signal input 76 of the shift register 500 is connected to the output of a squarewave signal generator 77 whose frequency F is slightly different from the frequency of the supply voltage. For example, if the supply voltage is 50 Hz, the frequency F may be chosen to be 50.05 Hz. To obtain a stable difference of 0.05 Hz, an oscillator may be used which is phase-locked with respect to the a.c. supply voltage as is shown in FIG. 7. A voltage-controlled oscillator 78 is adjusted to a frequency of 50 kHz. Its output is connected to a frequency divider 79 of the ratio 1000, having a phase comparator 60 connected to its output, comparing the phase of the signal obtained by division with that of the alternating supply voltage applied to the terminal 61. The result of the comparison is applied in the form of a correction voltage to the controllable oscillator 78 which is locked in phase with the a.c. supply voltage.

A further frequency divider 62 of the ratio 999 receives the output signal from the oscillator 78 and provides a signal N at the output whose frequency is in the ratio 1000/999 at any instant with the frequency of the supply voltage.

The signal N is subsequently formed by a monostable multivibrator 63 providing a squarewave signal M whose active pulses triggered by the short pulses of the signal N have a duration of, for example, 8 ms and are separated by intervals of approximately 12 ms. Finally the signal M is applied to the signal input 76 of the shift register 500.

For operating the transfer of the signals in the register 500 the signals supplied by a multivibrator 66 functioning at a frequency of, for example, 2 kHz are applied to its clock input 65.

Under the conditions mentioned the luminous dot matrix, which may be scanned in rows or columns, shows a quasi-continuous variation of the background colour whose basic cycle for a given dot covers 20 seconds and which shows a display at any instant from green to red in 20 rows or columns. Other coloured animations and rhythms may of course be obtained by modifying the values indicated by way of example.

What is claimed is:

1. A device for data display, comprising a matrix of luminous dots disposed in rows and columns on a support, each luminous dot having a first and a second connection terminal and comprising at least one pair of light-emitting diodes, the first diode of the pair emitting light in a first colour and being connected in accordance with a given polarity to said first and second connection terminals, the second diode of the pair emitting light in a second colour different from the first colour and being connected to said connection terminals in inverse polarity with the first diode, said display furthermore comprising an a.c. voltage supply source whose output terminals are coupled to the connection terminals of the luminous dots by means of electronic switches controlled by a control signal generator for generating signals, which signals are chosen to be time-variable to render the switches conducting during one and/or the other cycle of the supply voltage in accordance with a colour variation requirement desired for the light emission of a matrix dots, characterized in that the colour variation requirement determined by said control signals is independent of the data to be displayed and provides a colour variation referred to as "background" for the matrix of dots for which the first and second connection terminals are coupled to the respective output terminals of the supply source in accordance with the given polarity referred to as "background polarity", whereas other matrix dots selected for representing the data to be displayed have their first and second connection terminals coupled to the respective output terminals of the supply source in accordance with a polarity which is inverse to the background polarity.

2. A device as claimed in claim 1 characterized in that said first and second output connections of the luminous dots are mounted in the device in a removable way of means of a pin-pluggable connection with the support.

3. A device as claimed in claim 1 or 2, characterized in that a plurality of luminous dots is coupled to the output terminals of the supply source by means of one of said electronic switches, said plurality of dots forming a figure on the matrix referred to as "elementary background figure" which is independent of the data to be displayed.

4. A device as claimed in claim 3, characterized in that the elementary background figure is an array of dots, namely a row or a column.

5. A device as claimed in claim 3, characterized in that the control signal generator comprises at least one shift register with m stages in which the control signal is submitted to a time shift and in that each of the m output terminals of said shift register is connected to a control terminal of the electronic switch controlling the supply of each of the m pluralities of luminous dots forming the elementary background figure.

6. A device as claimed in claim 5, characterized in that the control signal generator comprises a first assembly of shift registers having m stages with which a first set of buffer amplifiers with a controllable signal transfer is associated, which set is enabled during the cycles of a first polarity of the supply voltage, and a second assembly of shift registers having m stages with an associated second set of controllable buffer amplifiers which are enabled during the cycles of the second polarity, in that the shift registers are interconnected in the form of a ring between the input and the last output and in that the initiation of the control signals circulating in the ring of registers is obtained by temporarily closing a switch applying a given voltage level to an input.

7. A device as claimed in claim 5, characterized in that the control signal generator comprises a square-wave signal generator whose frequency is slightly different from the frequency of the supply voltage and whose signals are applied to the input of said shift register having m stages.

* * * * *